US007686288B2

(12) United States Patent
Wetzel et al.

(10) Patent No.: US 7,686,288 B2
(45) Date of Patent: Mar. 30, 2010

(54) METHOD AND DEVICE FOR FURTHER PROCESSING OF SHEETS TO PRODUCE MULTI-PAGE PRINTED PRODUCTS

(75) Inventors: Hagen Wetzel, Oppenweiler (DE); Claus-Dieter Redmer, Oppenweiler (DE); Eberhard Krieger, Weinstadt-Strümpfelbach (DE)

(73) Assignee: Maschinenbau Oppenweiler Binder GmbH & Co. KG, Oppenweiler (DE)

( * ) Notice: Subject to any disclaimer, the term of this patent is extended or adjusted under 35 U.S.C. 154(b) by 556 days.

(21) Appl. No.: 11/654,803

(22) Filed: Jan. 18, 2007

(65) Prior Publication Data

US 2008/0175691 A1 Jul. 24, 2008

(51) Int. Cl.
*B65H 37/04* (2006.01)

(52) U.S. Cl. ..... 270/32; 270/20.1; 270/52.14; 270/52.16; 270/52.26; 270/52.29

(58) Field of Classification Search ..... 270/8, 270/9, 20.1, 32, 52.14, 52.16, 52.26, 52.29, 270/52.3

See application file for complete search history.

(56) References Cited

U.S. PATENT DOCUMENTS 1,942,399 A 1/1934 Gale
1,962,407 A 6/1934 Pierce
4,747,817 A * 5/1988 Newsome ..... 493/438
5,090,672 A * 2/1992 Ballestrazzi et al. ..... 270/45
5,779,232 A * 7/1998 Ochsner ..... 270/45
6,363,851 B1 * 4/2002 Gerhard et al. ..... 101/483
6,827,679 B2 12/2004 Villanueva et al.
7,077,797 B2 * 7/2006 Villanueva et al. ..... 493/395

FOREIGN PATENT DOCUMENTS

| | | |
|---|---|---|
| DE | 86 20 706 | 4/1987 |
| EP | 1 005 984 | 6/2000 |
| EP | 1 568 507 | 8/2005 |
| GB | 1 478 706 | 7/1977 |

* cited by examiner

*Primary Examiner*—Gene Crawford
*Assistant Examiner*—Leslie A Nicholson, III
(74) *Attorney, Agent, or Firm*—Bachman & LaPointe, P.C.

(57) ABSTRACT

A method and a device for further processing of sheets to produce multi-page printed products, several initial sheets (19) are each folded into a folded sheet (20) and subsequently collated one on top of the other such that the fold areas lie at the top and the folded sheets (20) open downwardly. A grooved line (30) is formed in each initial sheet (19) before folding, around which grooved line (30) the initial sheet (19) is subsequently folded, the depth and the width of the grooved line (30) being increased, initial sheet (19) by initial sheet (19), by a predetermined amount.

2 Claims, 2 Drawing Sheets

METHOD AND DEVICE FOR FURTHER PROCESSING OF SHEETS TO PRODUCE MULTI-PAGE PRINTED PRODUCTS

BACKGROUND OF THE INVENTION

The invention relates to a method and a device for further processing of sheets to produce multi-page printed products, wherein several initial sheets are each folded into a folded sheet and subsequently collated one on top of the other such that the fold areas lie at the top and the folded sheets open downwardly, a groove being formed in each initial sheet before folding, around which groove the initial sheet is subsequently folded, the groove being widened, initial sheet by initial sheet, by a predetermined amount.

Such a method and such a device are known from EP 1 568 507 A1. The device described in this publication comprises a grooving means having two grooving wheels forming two parallel grooved lines in each initial sheet before folding, wherein an adjusting means controlled by a control means is provided, which adjusting means increases the distance between the grooving wheels gradually each time after the forming of grooved lines in a preceding initial sheet. The grooving of the initial sheets at a constantly increasing distance between the two grooved lines makes it possible to collate the folded sheets one on top of the other such that the folded sheets are able to lie planely one on top of the other in the spine area between the grooved lines and that the individual pages after the bonding thereof remain folded around clearly defined fold edges, resulting in a high-quality appearance of the finished printed product and in the fact that the individual folded sheets may be securely bonded, for example, by means of glueing. However, the construction of the known device is very expensive, since two grooving wheels are required, the distance between which has to be adjusted through the adjusting means.

The object underlying the invention is to provide a method and a device for further processing of sheets to produce multi-page printed products which make it possible, by means of a relatively inexpensive construction, to enable a high-quality appearance of the finished printed product.

SUMMARY OF THE INVENTION

This object is achieved a method for further processing of sheets to produce multi-page printed products, wherein several initial sheets are each folded into a folded sheet and subsequently collated one on top of the other such that fold areas lie at the top and said folded sheets open downwardly, a grooved line being formed in each of said initial sheets before folding, around which grooved line said initial sheet is subsequently folded, the depth and the width of said grooved line being increased, initial sheet by initial sheet, by a predetermined amount.

The object is further obtained by a device for further processing of sheets to produce multi-page printed products comprising a folding unit for folding initial sheets into a folded sheet around a grooved line, grooving means provided upstream of said folding unit in a sheet running direction, said grooving means comprising a grooving wheel having a convex curvature at its outer circumference and forming a grooved line in each of said initial sheets passing through in a running plane before folding, and collating means in which said folded sheets are collated one on top of the other such that a fold area lies at the top and said folded sheets open downwardly, wherein adjusting means controlled by control means is provided, which adjusting means advances said grooving wheel gradually each time after the forming of a grooved line in an initial sheet towards the direction of the running plane.

According to the invention, the depth and the width of the grooved lines is increased by advancing the grooving wheel gradually each time after the forming of a grooved line in a preceding initial sheet towards the direction of the running plane. Even if the sheets are folded only along a single grooved line before being collated, the appearance of the finished printed product at the spine is of high quality, since a succeeding folded sheet may be placed along its fold edge on top of the fold edge of the preceding folded sheet without the downwardly extending pages of the folded sheets affecting each other mutually.

BRIEF DESCRIPTION OF THE DRAWINGS

An exemplary embodiment of the invention will be explained in greater detail below with reference to drawings, in which.

DETAILED DESCRIPTION

Figure 1:
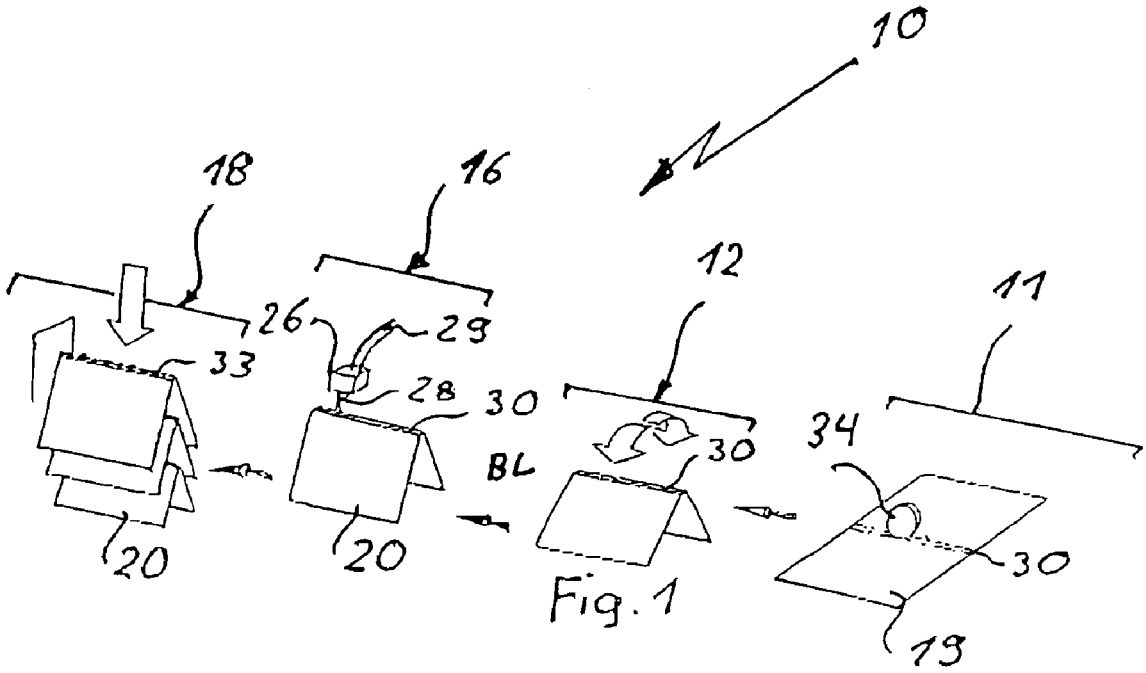
FIG. 1 shows a device for further processing of sheets to produce a printed product, FIG. 2 schematically shows a grooving wheel for grooving a first preceding initial sheet in a first grooving position.

The device 10 shown in FIG. 1 for further processing of sheets to produce a printed product comprises, one after the other, as seen in a sheet running direction BL, grooving means 11, folding means 12, adhesive applying means 16, and collating means 18.

The grooving means 11 comprises a grooving wheel 34 arranged along the center line of an initial sheet 19 and being rotatable about a rotational axis 38 (FIG. 2), which extends in parallel to the initial sheet 19 and perpendicularly to the sheet running direction BL. During the passage of an initial sheet 19 coming from the sheet feeder (not shown) the grooving wheel 34 forms a grooved line 30 extending in the sheet running direction in the surface of the initial sheet 19.

Figure 2:
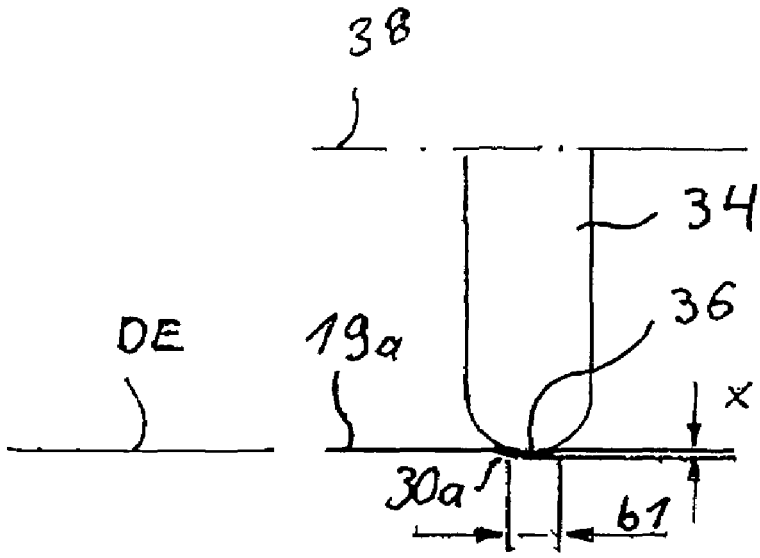
Figure 3:
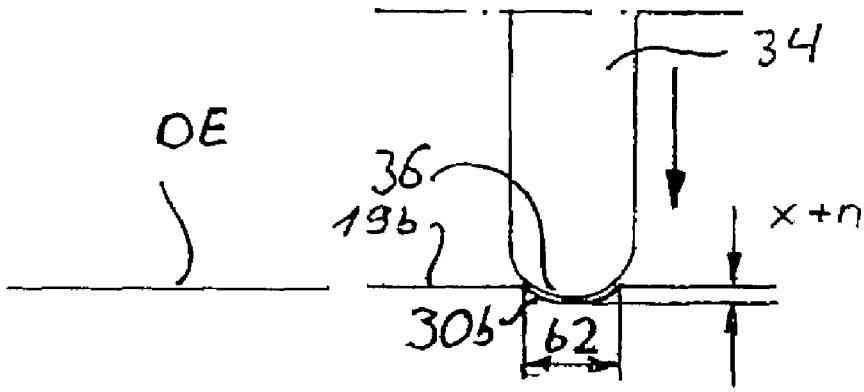
FIG. 3 shows the grooving wheel of FIG. 2 in a grooving position for grooving a second succeeding initial sheet.
Figure 4:
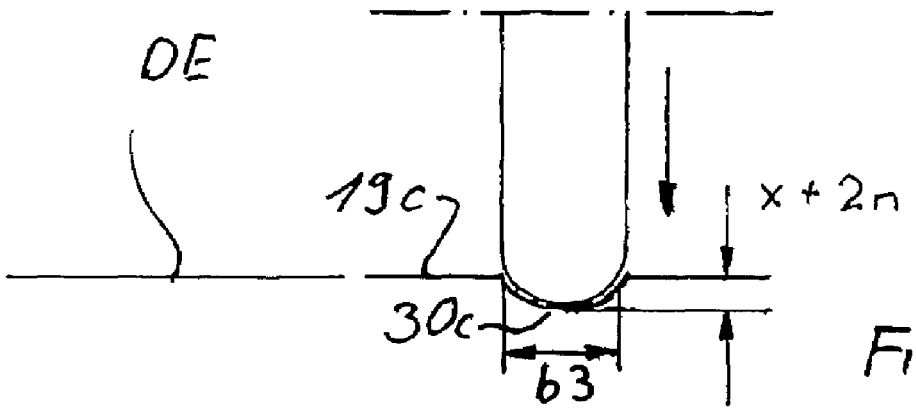
FIG. 4 shows the grooving wheel of FIG. 2 in a grooving position for grooving a third succeeding initial sheet.

As can be seen from FIGS. 2 to 4, the grooving wheel 34 is gradually adjustable through adjusting means (not shown) controlled by control means towards the direction of the running plane DE of the initial sheets 19. The grooving wheel 34 comprises a convex curvature 36 at its outer circumference.

As shown in FIG. 2, in order to form a grooved line 30*a* in a first preceding initial sheet 19*a*, the grooving wheel 34 is adjusted to such an extent towards the direction of the running plane DE that the grooved line 30*a* has a depth x and a width b1.

FIG. 3 shows that the grooving wheel 34 for forming a grooved line 30*b* in a second initial sheet 19*b* succeeding the first initial sheet 19*a* is adjusted by an amount n further towards the direction of the running plane DE. Through this, a grooved line 30*b* having a depth x+n and a width b2 is formed, said width b2 due to the curvature 36 of the grooving wheel 34 being wider than the width b1 of the grooved line in the first initial sheet 19*a*.

After the passage of the second initial sheet 19*b* the grooving wheel 34 is again adjusted by the amount n towards the direction of the running plane DE, resulting in a depth x+2n of the grooved line 30*c* in a third succeeding initial sheet 19*c* and a width b3 that is again larger than the width b2 in the second initial sheet 19*b*.

The folding means 12 is constituted by a former folding unit or a plow folding unit or a similar folding unit that folds the initial sheets 19 made of paper along the grooved line 30 extending in the sheet running direction BL such that the folded sheet 20 opens downwardly.

The adhesive applying means 16 comprises a glueing head 26, at the front end of which an adhesive nozzle 28 is provided. The glueing head 26 is connected via a duct 29 to an adhesive reservoir (not shown). The adhesive nozzle 28 is arranged immediately above the grooved line 30 when the folded sheet 20 is supplied to the adhesive applying means 16. Controlled by control means (not shown), adhesive dots 33 are applied at a predetermined distance and in a predetermined quantity from above by the adhesive applying means 16 onto the grooved line 30. Subsequently, the folded sheets 20 are collated one on top of the other in the collating means 18 and bonded together by means of the adhesive.

Since the width b1, b2, b3 of the grooved line 30*a*, 30*b*, 30*c* increases with each succeeding folded sheet 20, the downwardly extending pages of the folded sheets 20 do not affect each other mutually, whereby a high-quality appearance of the finished printed product is achieved. The curvature or curve 36 at the outer circumference of the grooving wheel 34 is selected such that in the case of a corresponding adjustment of the grooving wheel 34 the desired depth and width of the grooved line 30 is achieved in the respective initial sheet 19.

The invention claimed is:

1. A device for further processing of sheets to produce multi-page printed products comprising:

a folding unit for folding initial sheets into a folded sheet around a grooved line;

grooving means provided upstream of said folding unit in a sheet running direction, said grooving means comprising a grooving wheel having a convex curvature at its outer circumference and forming a grooved line in each of said initial sheets passing through in a running plane before folding; and collating means in which said folded sheets are collated one on top of the other such that a fold area lies at the top and said folded sheets open downwardly, wherein adjusting means controlled by control means is provided, which adjusting means advances said grooving wheel gradually each time after the forming of a grooved line in an initial sheet towards the direction of the running plane.

2. A method for processing a plurality of sheets to produce a multi-page printed product comprising:

providing a plurality of sheets;

sequentially feeding the plurality of sheets and forming a grooved line having a concave bottom on each of the sequentially fed sheets, the grooved line having a depth and a width which increases in size on each sequentially fed sheet;

folding the plurality of sequentially fed sheets on the grooved line to produce a plurality of folded sheets; and collating the plurality of folded sheets one on top of the other wherein each of the folded sheets opens downwardly to provide a tent structure of folded sheets comprising an inverted V, wherein the grooved line width and depth increases from bottom to top of the collated folded sheets.

* * * * *